United States Patent [19]

Mulcahy

[11] Patent Number: 5,046,866

[45] Date of Patent: Sep. 10, 1991

[54] MULTI FRICTION SIDE BEARING FOR A RAILCAR TRUCK

[75] Inventor: Harry W. Mulcahy, Griffith, Ind.

[73] Assignee: AMSTED Industries Incorporated, Chicago, Ill.

[21] Appl. No.: 582,422

[22] Filed: Sep. 14, 1990

[51] Int. Cl.[5] ..... F16C 17/04

[52] U.S. Cl. ..... 384/423

[58] Field of Search ..... 384/423, 420, 595; 105/199.3

[56] References Cited

U.S. PATENT DOCUMENTS

| | | | |
|---|---|---|---|
| 2,046,391 | 7/1936 | Latshaw . | |
| 2,530,495 | 11/1950 | Waldrogel . | |
| 3,712,691 | 1/1973 | Cope . | |
| 3,748,001 | 7/1973 | Neumann et al. . | |
| 3,762,338 | 10/1973 | Dwyer, Jr. . | |
| 3,762,339 | 10/1973 | Dwyer, Jr. . | |
| 3,888,555 | 6/1975 | Van Moss | 384/423 |
| 3,897,737 | 8/1975 | Davis . | |
| 3,961,584 | 6/1976 | Paton et al. . | |
| 4,130,066 | 12/1978 | Mulcahy . | |
| 4,381,589 | 5/1983 | Cope . | |
| 4,434,720 | 3/1984 | Mulcahy et al. . | |
| 4,715,290 | 12/1987 | Hood . | |

*Primary Examiner*—Lenard A. Footland

*Attorney, Agent, or Firm*—Edward J. Brosius; F. S. Gregorczyk

[57] ABSTRACT

A self leveling bearing for use on a freight railcar truck bolster having a major body with an arcuate undersurface and an upper friction face and a secondary friction body biased outwardly of a cavity within the upper friction face.

11 Claims, 2 Drawing Sheets

MULTI FRICTION SIDE BEARING FOR A RAILCAR TRUCK

BACKGROUND OF THE INVENTION

This invention relates to an improved bearing for use between a railcar truck and the underframe of a railcar body and more particularly is directed to a self leveling bearing having plural sliding friction characteristics responsive to plural load conditions.

The usual railcar assembly comprises a car body supported upon at least one and usually two trucks that, in turn, are carried on axles and wheel sets. The interconnection between truck and car body must permit relative rotation so that the truck may turn as the railcar negotiates curved truck. In the preponderance of freight cars in domestic use the interconnection includes circular center bearing plates and/or bowls mounted centrally of the truck and also transversely centered on the underframe of a car body end. Accordingly, the truck may turn or pivot on the centerplate under the car body and, under certain dynamic conditions and car speeds during operation, the truck may tend to adversely oscillate or "hunt" in a yaw-like manner beneath the car body. Also the car body is subject to adversely roll from side to side during operation. Side bearings are commonly employed to control both such adverse conditions. Heretofore such side bearings have been located on the truck outboard of the center plate and inboard of the wheels to slidingly contact pads secured to the car body underframe. Furthermore, according to a new truck and truck bolster design (disclosed and claimed in a copending U.S. patent application) truck side bearings located outboard of the wheels may be employed to fully support the car and eliminate the need for a center plate.

However, a shortcoming of prior side bearings is that they have offered a single frictional characteristic that is effective for only a limited range of operating conditions. For instance the frictional characteristic has been largely dependent upon the material and size of the bearing surface; but resistance to relative movement also depends on car load and, since car operation is most critical at a fully loaded condition, the side bearings have been designed to permit but adequately dampen sliding movement when the rail car is fully loaded. Unfortunately, this has resulted in inadequate motion damping when the railcar is run empty or under light weight loading. This shortcoming is particularly distressing in the operation of so called "unit" trains which transport a single type of cargo (such as coal) in one direction from a supplier for delivery to a purchaser and then return empty and at high speed in the reverse direction; and where the railcars incorporate light weight construction the damping problem is worsened for empty runs.

Another shortcoming of prior sliding friction type side bearings is that they have been essentially rigidly installed on the truck and/or car body members with the result that the friction face or surface is relatively fixed and non-adjustable with respect to a tilting attitude of the truck and/or car body. This has resulted in the bearing friction face or surface not always being parallel or level with respect to the car body counterpart that is slidingly engaged with consequent loss of effective surface contact.

SUMMARY OF THE INVENTION

Therefore it is an object of the present invention to provide an improved friction bearing having multiple friction characteristics responsive to changes in load conditions.

Another object of the present invention is to provide an improved friction bearing that is self adjusting with respect to its mounting and counterpart in sliding contact.

A further object of the present invention is to provide an improved truck side bearing for supporting light weight railcars.

Accordingly, the present invention involves a major friction body that has a flat first friction face and an arcuate undersurface so as to be receivable in a congruent seat, and a secondary friction body that is spring biased outwardly of a cavity in the major friction body.

BRIEF DESCRIPTION OF THE DRAWINGS

Other objects and advantages of the present invention will become apparent from the following detailed description in conjunction with the drawings wherein.

DETAILED DESCRIPTION OF THE INVENTION

Figure 1:
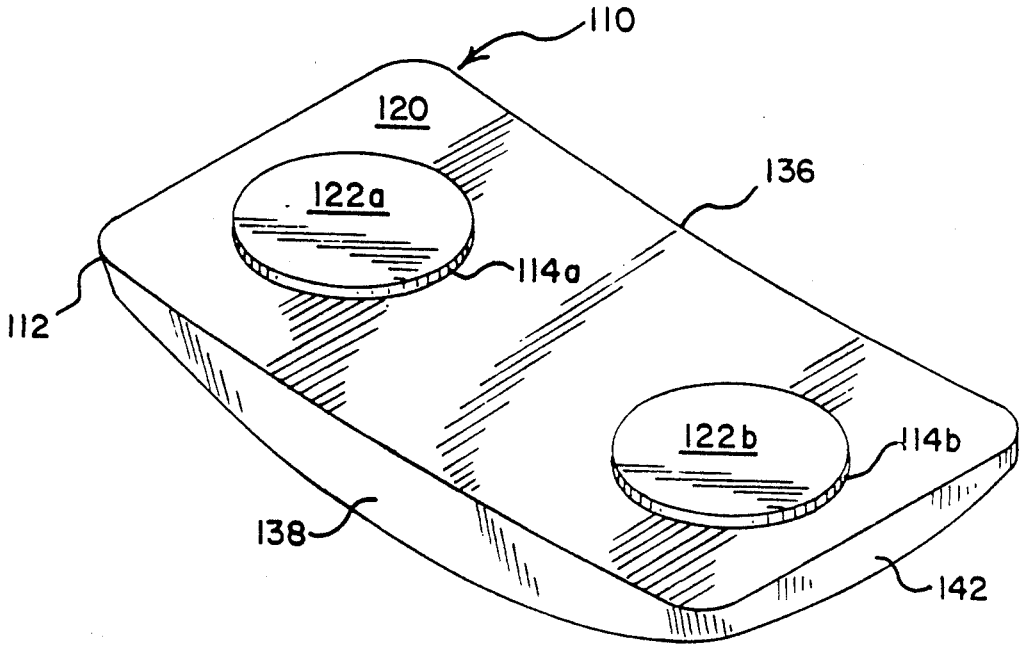
FIG. 1 is a perspective view of a preferred bearing member according to the present invention.
Figure 2:
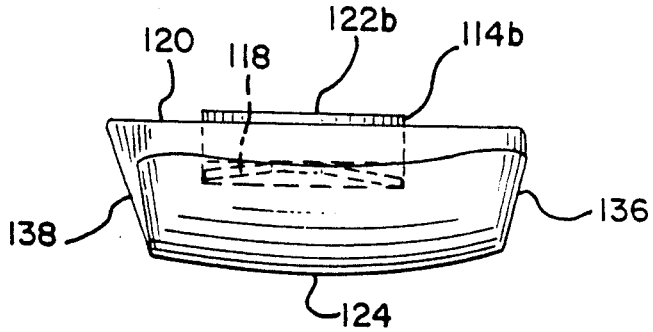
FIG. 2 is a sectional side elevation of the bearing member of FIG. 1.
Figure 3:
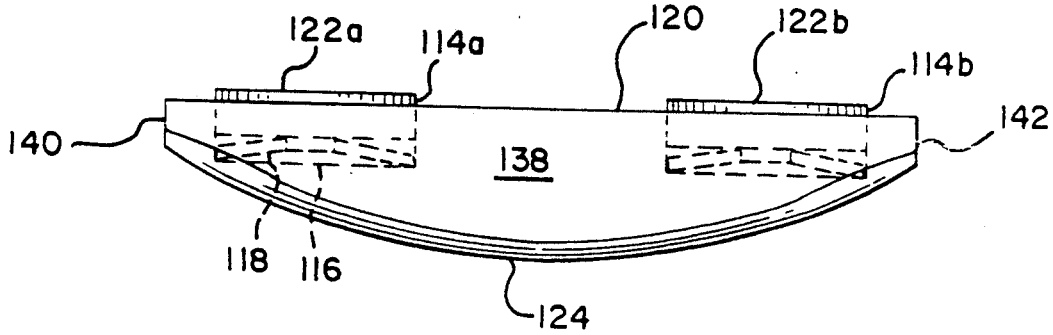
FIG. 3 is an end elevation view of the bearing member of FIG. 1.
Figure 4:
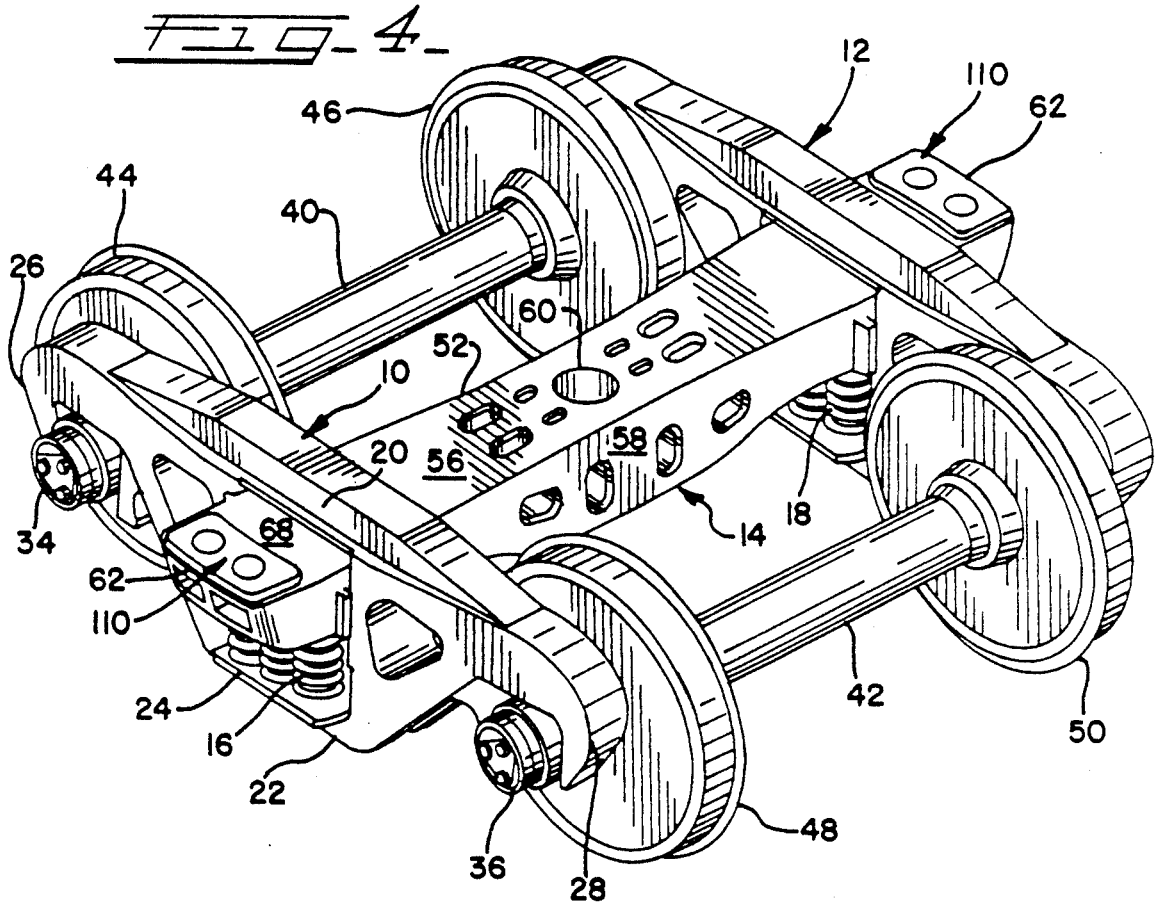
FIG. 4 is a perspective view of a unique railcar truck with bearing members according to FIG. 1 installed thereon.

As shown in FIGS. 1–3 the present invention is a bearing member generally 110 comprising a major friction body 112 having a flat friction face 120 that surrounds at least one and preferably two secondary friction bodies 114*a* and 114*b*. The illustrated preferred embodiment of the bearing member 110 was devised for a new and unique three piece rail car truck shown in FIGS. 4 and 5 to comprise two side frames generally 10, 12 and a unique transverse bolster generally 14 supported on coil springs 16, 18 carried by the side frames 10, 12 respectively. Each of the side frames, usually of cast steel, includes an upper compression member 20, a lower tension member 22 having a spring seat 24 and two pedestal jaws 26, 28. The latter are carried upon journal bearings 34, 36 fitted upon a pair of axles 40, 42 outboard of wheel sets 44, 46 and 48, 50, respectively.

Figure 5:
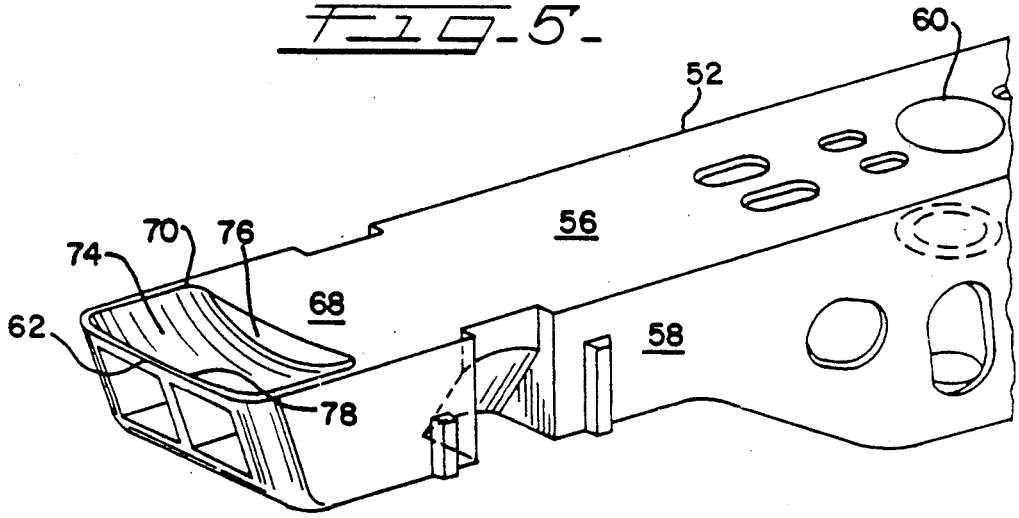
FIG. 5 is an enlarged detail view of one half of a truck bolster according to FIG. 2 with the bearing member removed.

The bolster 14, best seen in FIG. 5, preferably also of cast steel, has a box-like body 52 with top wall 56, bottom wall (not shown) and interconnecting side walls 58. A pin receptor 60 is centrally located in top wall and two distal ends 62 extend outwardly of the body 52 at a distance from the receptor 60 beyond the side frames 10, 12. Each distal end 62 includes horizontal surfaces 68 adapted to directly carry a rail car body (not shown) at or adjacent the side sills thereof. Preferably a bearing member generally 110 is located on each of the surfaces 68 to permit controlled sliding movement between the surfaces 68 and pads (not shown) secured to the car under body on or adjacent the side sills.

It will be understood that the illustrated truck bolster 14 carries the weight of a car body at the side sills rather than upon a center sill which heretofore has been the standard practice for freight car construction. In this way the car under frame structure may be simplified and lightened and the need for a traditional transverse body bolster above each truck bolster may be eliminated. The illustrated truck bolster 14 thus does not require a center bearing bowl to support the car body, however, a central vertical connection such as a column or pin (not shown) is located between the central receptor 60 on bolster 14 and the car center sill so as to establish a center of rotation between truck and car body and to transmit horizontal forces between truck and car body. However, the present bearing member 110, as illustrated in FIGS. 1-3 is also useful on freight car truck bolsters as side bearings located between a central pin receptor and the side frames, and may also have still other applications.

In the illustrated freight car truck application each end surface 68 of bolster 14 is provided with a concave seat 70 having a bottom spherical segment surface 74 extending between the bolster sidewalls 58 and an inner cylindrical wall 76 and an outer conical wall 78 so as to receive a preferred bearing member 110. The latter must fundamentally present a bearing surface area and composition sufficient to withstand the compressive forces expected for the car with a full load while permitting sliding movement so as to enable truck curving beneath the car body, yet also function to provide sufficient frictional resistance engagement with pads on the car body to control truck hunting (transverse and/or yaw oscillations) under no load (empty rail car) or low load conditions. This is accomplished by the present invention with a major friction body 112, comprised of a relatively low friction material such as teflon coated machined steel that has a first friction coefficient $F_1$ of about 0.05-0.07, which surrounds a secondary friction body 114 of relatively higher friction material such as cast steel that has a second friction coefficient $F_2$ of about 0.35. The secondary friction body 114 is received in a cavity 116 in the major friction body 112 and is urged outwardly by an elastic biasing means or member 118. In the preferred embodiment illustrated the major friction body 112 also contains two secondary friction bodies in the form of circular discs **114*a* and 114*b*. Both major and secondary friction bodies 112, 114 have flat upper friction surfaces or faces 120, 122*a* and 122*b* that will bear against the pads on a car body. It will be understood that the frictional resistance to sliding motion between each bearing member 110 and car body pad of a loaded car will have two components. One component R-1 will be the product of the car weight (including load) bearing on the friction face 120 of the major friction body 112 and the first coefficient of friction $F_1$. The second component R-2 will be an essentially constant product of the total force of biasing members 118, bearing on the secondary surfaces 122*a* and 122*b*, of the secondary friction bodies 114*a* and 114*b*, and the second coefficient of friction $F_2$. The second component is, by selected design parameters, made sufficient to control the tendency of a given truck configuration to hunt at expected empty car operating speeds. Each biasing member 118 may be of any suitable type but is preferably a Belleville spring 118 (essentially a conical segment of spring steel) and preferably is of sufficient stiffness to force the surface 122 of each secondary friction body 114 outwardly of the major friction body 112 so as to independently support the car-body pad slightly spaced above friction face 120** when the car is not loaded.

The bearing member generally 110 is preferably in the form of a slightly arcuate shoe having a spherical undersurface 124 that is received in the congruent recessed seat 70 on the surface 68 of each bolster end 62. In this way each bearing member 110 will be self leveling on each bolster end 62 against its car-body pad under the weight of the car body.

It will be seen in FIGS. 1-3 that the bearing member body includes concentric arcuate end walls 136, 138 and straight side walls 140, 142 extending between the spherical undersurface 124 and the friction face 120. The arcuate end walls 136, 138 are formed to be concentric with the respective inner cylindrical wall 76 and outer conical wall 78 of a bearing seat 70 and the bearing body 112 is sized to fit therein. For a bolster of 9 foot 11⅞ inch maximum dimension where the bolster distal ends 62 are 16.88 inches wide and terminate in outer arcs having radii of 59.94 inches, the bearing seat 70 is located to leave walls approximately ½ inch thick at the distal ends 62 and adjacent side portions and the inner cylindrical wall 76 is formed on a radius of 50.56 inch measured from the center of the bolster pin receptor 60. It is desirable that each bearing member 110 be sized to leave a peripheral gap of about 0.44 inch between its peripheral walls 136, 138, 140 and 142 and the perimeter of the bearing seat 70. Accordingly, the bearing body 112 is cast to be approximately 15 inches between side walls 140, 142 and 8 inches between arcuate walls 136, 138 with inner wall 136 formed on a radius of 51 inches and the outer conical wall 138 formed from a top radius of 59 inches. Two secondary friction discs **114*a*, 114*b* of 4 inch diameter are located in cavities 116 of slightly greater diameter. The convex spherical undersurface 124 of each bearing member and the concave spherical surface 74 of bearing seat 70** are typically formed on radii of 15 inches.

Variations and modifications may be made without departing from the spirit and scope of the invention which is defined in the following claims.

What is claimed is:

1. A friction bearing for use between a vehicle body and a truck supporting said body, said bearing comprising:

a major friction body having a flat first friction face;

a cavity in said major friction body; and a secondary friction body having a flat secondary friction face seated in said cavity, said first and said secondary friction faces being parallel and said secondary friction face being movable between positions spaced from and coplanar with said first friction face.

2. The friction bearing of claim 1 wherein said major friction body has an arcuate underside opposite said first friction face.

3. The friction bearing of claim 1 wherein said first and secondary friction faces having different coefficients of friction.

4. The friction bearing of claim 1 including biasing means within said cavity urging said secondary friction body outwardly thereof.

5. A friction bearing for use between a vehicle body and a truck supporting said body, said bearing comprising:

a major friction body having a flat first friction face;

a pair of cavities in said major friction body and said first friction face;

secondary friction bodies having flat secondary friction faces seated in said cavities;

and a biasing means within each said cavity urging said secondary friction body outwardly thereof.

6. The friction bearing of claim 5, wherein said major friction body has a spherical undersurface opposite said first friction face.

7. The friction bearing of claim 5 wherein said first friction face consists of a material different from said secondary friction faces.

8. The friction bearing of claim 5 wherein said first and second friction faces have different coefficients of friction.

9. The friction bearing of claim 5 wherein said first friction face has a coefficient of friction that is less than the secondary friction face.

10. The friction bearing of claim 5 wherein said major friction body has an arcuate undersurface opposite said first friction face.

11. A friction bearing for use between a railcar body and a railcar truck pivotally supporting said body, said bearing comprising:

a major friction body having a flat first friction face and a spherical underside opposite said first friction face;

a pair of cylindrical cavities located in and surrounded by said first friction face, said cavities extending into said major friction body;

a spring seated within each said cavity; and secondary friction bodies in the form of discs having flat secondary friction faces mounted on each said spring, said secondary friction faces substantially conforming to the cavities in said first face and held parallel to said first face.

* * * * *